US005902939A

United States Patent [19]

Ballard et al.

[11] Patent Number: 5,902,939

[45] Date of Patent: May 11, 1999

[54] PENETROMETER SAMPLER SYSTEM FOR SUBSURFACE SPECTRAL ANALYSIS OF CONTAMINATED MEDIA

[75] Inventors: John H. Ballard, Clinton; Ernesto R. Cespedes; Dan Y. Eng, both of Vicksburg, all of Miss.

[73] Assignee: U.S. Army Corps of Engineers as represented by the Secretary of the Army, Washington, D.C.

[21] Appl. No.: 08/660,321

[22] Filed: Jun. 4, 1996

[51] Int. Cl.[6] ..... E21B 49/08

[52] U.S. Cl. ..... 73/863.12; 73/864.74; 73/864.81

[58] Field of Search ..... 73/864.73, 864.74, 73/864.81, 864.34, 864.35, 863.11, 863.12, 152.55, 152.02, 152.24; 250/255, 269.1, 254; 175/58, 59, 50, 20, 21

[56] References Cited

U.S. PATENT DOCUMENTS

| | | | |
|---|---|---|---|
| 4,669,554 | 6/1987 | Cordry | 175/59 |
| 5,128,882 | 7/1992 | Cooper et al. | 364/550 |
| 5,246,862 | 9/1993 | Grey et al. | 436/28 |
| 5,316,950 | 5/1994 | Apitz et al. | 422/428 |
| 5,358,057 | 10/1994 | Peters et al. | 73/864.74 |
| 5,379,103 | 1/1995 | Zigler | 356/73 |
| 5,435,176 | 7/1995 | Manchak, III | 73/151 |
| 5,445,795 | 8/1995 | Lancaster et al. | 422/86 |
| 5,503,031 | 4/1996 | Scott et al. | 73/864.74 |

*Primary Examiner*—Robert Raevis
*Attorney, Agent, or Firm*—Luther A. Marsh

[57] ABSTRACT

The present invention pertains to a direct push small diameter fluorescence based penetrometer system for performing in situ spectral analysis on subsurface liquid or gaseous samples. The invention is configured to collect liquid or gaseous analyte samples within the penetrometer's sample chamber through a port that is juxtaposed to a heating element that accelerates the separation of volatile chemical materials from the soil matrix. Fiber optic cables are linked to surface mounted real-time data acquisition/processing equipment from the sample chamber. The penetrometer sampling device is also equipped with a standard penetrometer electric cone sensor module containing cone and sleeve strain sensors that are used to calculate soil classification/layering in real-time during penetration. The invention integrates soil classification/layering data with spectral signature data of suspect subsurface liquid or gaseous fluids for assessing whether the subsurface soil and ground water regions are contaminated without the requirement of transporting the sample and/or analyte to the surface for analysis. Moreover, the system integrates a means for grouting the bore hole upon retrieval of the penetrometer.

11 Claims, 3 Drawing Sheets

PENETROMETER SAMPLER SYSTEM FOR SUBSURFACE SPECTRAL ANALYSIS OF CONTAMINATED MEDIA

STATEMENT OF GOVERNMENT INTEREST

The invention described herein may be manufactured and used by or for the United States government for governmental purposes without the payment of any royalties thereon.

FIELD OF THE INVENTION

The invention pertains to a soil penetrometer system for onsite determination of soil contaminants by measurement of the spectral signature of liquids/vapors in the ground water/soil matrix.

BACKGROUND OF THE INVENTION

Environmental concern of soil and groundwater contamination along with governmental mandated requirements to remedy this problem has prompted the need for rapid and cost effective subsurface characterization methods to determine chemical contaminants therein. Prior traditional subsurface soil characterization techniques include collection of field samples and subsequent analysis in the laboratory for both chemical and elemental analysis. The samples are initially collected from a bore hole, monitoring well or penetrometer sampler which in turn are taken to a lab for analysis using standard analytical procedures, atomic absorption or inductively coupled plasma emission processes for determining the types of contaminants and concentration thereof. These traditional techniques take relatively long time periods to perform as to sample extraction and preparation to laboratory analysis thereof, thus not suitable for examining large land areas where soil contamination has occurred. Additionally, these prior techniques are prone to error due to loss of soil sample contaminant material prior to laboratory analysis resulting in less accurate results. An example of this methodology includes U.S. Pat. No. 5,435,176 by Manchek, III entitled "Hazardous Waste Characterize and Remediation Method & System," that teaches in one embodiment of that invention of taking siphoned samples of downhole vapors as well as core samples for analysis. This system transports examined vapors through connecting tubing to the surface using a heated carrier gas or fluid. Once on the surface, the vapors are analyzed using field portable analytical laboratory equipment. Note that this system's sampling technique uses a rotary drilling device to obtain measurements from the soil whereas the instant invention uses a push penetrometer system for in situ down hole analysis. Other types of penetrometer vapor samplers trap down hole vapors in absorbent chemical traps within the probe that are later brought to the surface for analysis.

Another in situ methodology for determining soil contaminants includes Grey et al.'s U.S. Pat. No. 5,246,862 entitles "Method and Apparatus for In Situ Detection and Determination of Soil Contaminants." This method requires use of reagent carrying tape that captures contaminants between the outer wall of the penetrometer and the soil wall formed by the penetrometer. An optical fiber coupling device transmits the response of a calorimetric reaction on the tape surface to the surface for analysis. U.S. Pat. No. 5,445,795 by Lancaster entitled "Volatile Organic Compound Sensing Devices" teaches of a vaporchromic sensor within a penetrometer unit with associated optical fiber techniques for detection of volatile contaminant compounds in the ground water/soil.

Yet other in situ methodologies include optical fiber penetrometer systems for determining both elemental and molecular contaminants. These systems use real-time monitoring methods using either: i) a fluorescence spectroscopic based system; or ii) a laser-induced breakdown spectroscopic (LIBS) based systems where emission spectra of elemental contaminants are gathered. Both fluorescence and LIBS systems are effective techniques for determining different compositional materials by irradiating the soil sample at differing radiant intensities. A fluorescence based technique is primarily used for examination of molecular materials such as petroleum hydrocarbons since fluorescent activity occurs when excited. The LIBS technique is primarily used for determining elemental atomic contaminants such as metals by breaking down molecular bonds of soil materials and reducing molecules into component atomic species which are in a plasma state that in turn produce emission spectrum of the atomic species which are in a plasma state that in turn produce emission spectrum of the atomic species. The LIBS based system requires features not found in a fluorescence based system such as a more durable light focusing subsystem for transmitting and receiving light signals in such a system due to the high peak irradiance values used. In particular, dielectric breakdown of a soil contaminant material requires flux values approximately 3 to 4 orders of magnitude greater than those needed for a fluorescence based system. LIBS is not a soil contamination determination system for use in quantifying molecular species concentration since most molecular materials in the soil dissociates during plasma production. In system form, these two techniques use different light excitation sources and components for focusing the light due to the differing required power levels for determining particular materials.

Examples of Fluorescence based soil penetrometer systems include U.S. Pat. No. 5,435,176 as discussed above that has a further embodiment of an optical fiber sensing system. Additionally, U.S. Pat. No. 5,128,882 of Cooper et al. entitled "Device for Measuring Reflectance and Fluorescence on In Situ Soil" and U.S. Pat. No. 5,316,950 of Apitz et al. entitled "Method for Quantitative Calibration of In Situ Optical Chemical Measurements in Soils Using Soil Class and Characteristics". These two additional teachings use a penetrometer probe that use a light source or low powered laser source, e.g. a $N_2$laser. These optical light sources operate at low power levels around $\mathbf{10}^4$W/cm$^2$range or less. The observed optical data determines what types of molecular chemical contaminants are present in the soil, e.g. petroleum hydrocarbons using their fluorescent spectra when excited by an electromagnetic (EM) ultra-violet light source.

U.S. Pat. No. 5,379,103 by Zigler entitled "Method and Apparatus for In Situ Detection of Minute Amounts of Trace Elements" is an example of the LIBS system where a mobile laboratory issued for in situ detection of organic and heavy metal contaminants in ground water. This teaching requires a much higher powered laser source with higher irradiance values of around $\mathbf{10}^8$W/cm$^2$for proper excitation of metallic materials for determining their respective emission spectra.

The pnetrometer system of the instant invention collects real-time soil classification/layering data similarly to those methods used in U.S. Pat. No. 5,128,882 and 5,316,950 as discussed above. This methodology allows for down hole real-time analysis of liquid/vaporous samples for detection of contaminants in the soil.

The instant invention's geophysical sensing sampler module has a self-contained heating and aspirating sample chamber in the probe for enhancing real-time data collection and spectral analysis of liquid and/or gaseous samples at various down hole locations during a single penetrometer push operation. The real time collection of subsurface stratification data is needed for determining locations where subsurface contamination is suspected and where sample analysis is desirable. The conduct of real-time spectral analysis on down hole samples in the penetrometer sampler module's sampling chamber is faster than conventional sampling methods, less expensive, and does not bring contaminants to the surface that may result in equipment contamination and/or the generation of contaminated wastes. This results in more accurate data when compared to previous in situ methods that use either the fluorescence or Roman penetrometer as discussed above, since the analyte is more efficiently separated from the soil matrix by localized heating by the penetrometer's sampler module in proximity to the examined soil formation, resulting in tine efficient, more accurate sampling of the soil under examination.

Accordingly, the present invention is an improved over current in situ fluorescence based systems that examine soil samples through a down hole window in the probe. In particular, it is more reliable and time efficient since contaminant analytes are gathered in the down hole sampler module's sample chamber.

SUMMARY OF THE INVENTION

The present invention pertains to a direct push, small diameter fluorescence based penetrometer system for performing in situ spectral analysis on subsurface liquid or gaseous samples. The invention is configured to collect liquid or gaseous analyte samples within the penetrometer's sample chamber through a port that is juxtaposed to a heating element that accelerates the separation of volatile chemical materials from the soil matrix. Fiber optic cables are linked to surface mounted real-time data acquisition/processing equipment from the sample chamber. The penetrometer sampling device is also equipped with a standard penetrometer electric cone sensor module containing cone and sleeve strain sensors that are used to calculate soil classification/layering in real-time during penetration. THE invention integrates soil classification/layering data with spectral signature data of suspect subsurface liquid or gaseous fluids for assessing whether the subsurface soil and ground water regions are contaminated without the requirement of transporting the sample and/or analyte to the surface for analysis. Moreover, the system integrates a means for grouting the bore hole upon retrieval of the penetrometer.

Accordingly, several objects of the present invention are:

(a) To provide a more reliable and operationally cost effective fluorescence based soil contaminant penetrometer system.

(b) To provide a fluorescence based soil contaminant system that can collect geophysical data during a penetrometer push/retrieval operation and integrate a means for grouting the hole after the data acquisition to prevent subsurface water contamination.

(c) To provide a fluorescence based soil contaminant system with an improved sampler chamber feature that aspirates liquid/vapor soil contaminant by localized heating of the soil.

(d) To provide a fluorescence based soil contaminant system with a protective sliding sleeve design that i) protects both the sampling port(s) and heating element during a penetrometer push operation and ii) allows exposure of the sampling port(s) within the sampler module for analyte collection.

(e) To provide a fluorescence based soil contaminant system with a protective retractable piston within a sampling port design within the sampler module that protects the sampling port(s) during a penetrometer push operation.

Still further advantages will become apparent from consideration of the ensuing detailed description.

DETAILED DESCRIPTION & OPERATION

Figure 1:
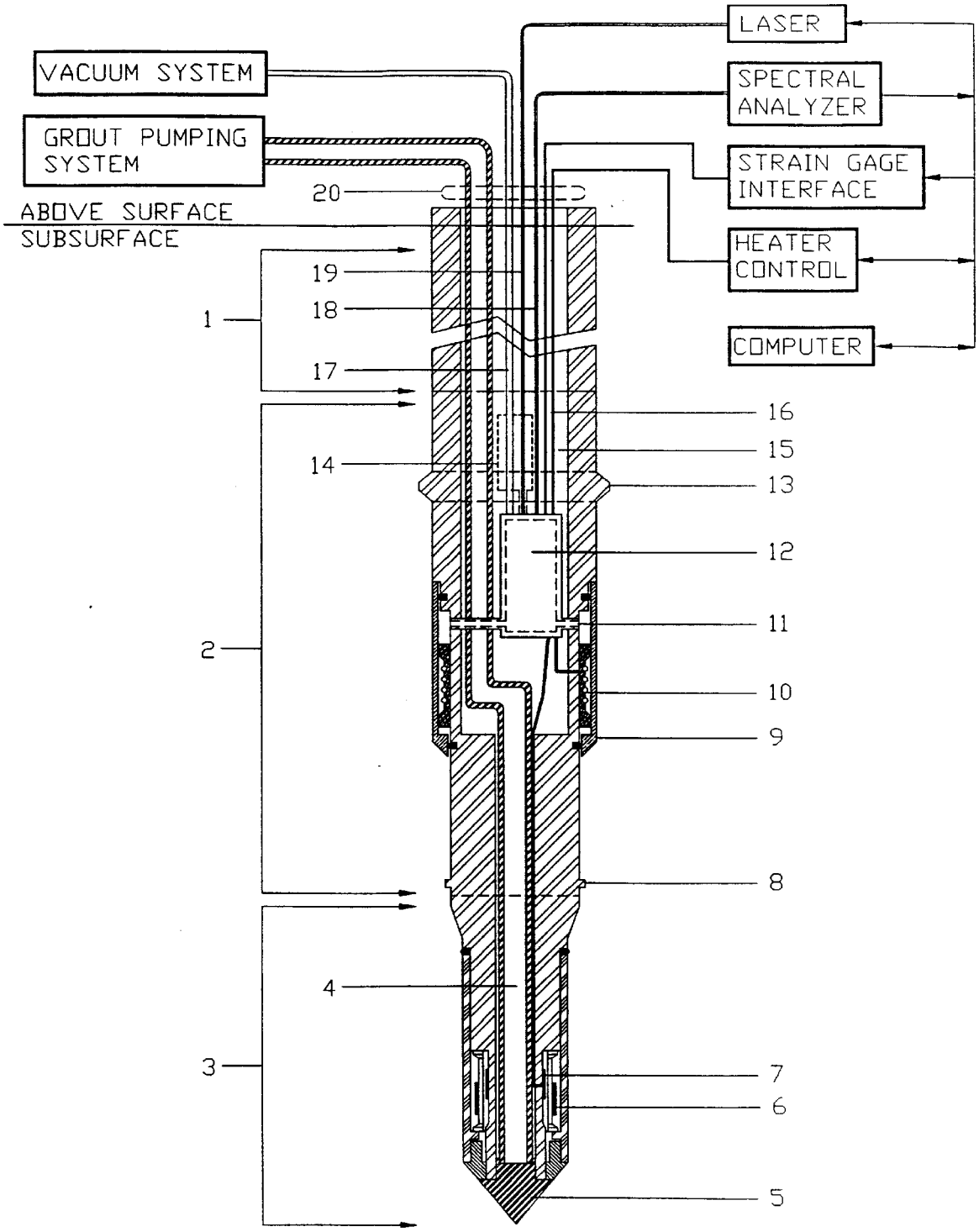
FIG. 1 shows the penetrometer system of the instant invention with a first embodiment of an aspirating sampler module with sampling port(s) covered during an initial penetrometer push operation to prevent clogging of the port(s).

The penetrometer operation and data acquisition is similar to that discussed in U.S. Pat. No. 5,128,882 and 5,316,950. The invention's penetrometer based system as shown in FIG. 1 comprises a direct push penetrometer probe with: (a) an electric cone module 3 that includes: i) sleeve 6 & cone strain 7 sensors for performing standard geophysical cone & sleeve sensory measurements for determining soil classification data, for example soil stratigraphical data, during an initial penetrometer push as is done in U.S. Pat. No. 5,316,950 and ii) an optional expendable grout tip 5 with grout tube that allows grout to pass through the cone tip as the penetrometer probe is retracted from a hole; (b) a sampler module 2 with an external mounted resistance coil heater 10 mounted on a ceramic material for heating adjacent soil that is formed by the penetrometer probe during an initial penetration that is located near the sampling port(s) 11, an interior sample chamber 12 that communicates with the soil through the sampling port(s) 11, and a sliding exterior mounted cylindrical sleeve 9 that surrounds the sampling port(s) 11 and resistance heater coils 10; (c) vacuum tubes 17, electrical heater power cable 15 & strain sensor cables 16, optional grouting tube 4 and fiber optic cables 18 & 19 that connect the penetrometer sample chamber 12 with surface mounted EM source & data acquisition/processing equipment; (d) and commercial hollow push rod segments 1 that physically connect to the lower sampler and cone modules of the penetrometer probe. The rod segments can also include a friction breaker member 13 to provide an enlarged bore hole wall and reduce to overall friction of the penetrometer push rod assembly. The electric cone module's 3 strain sensor transmission cables 16 and grouting tube 4 are passed through the sampler module 2 and hollow push rod segments 1 to the surface in an umbilical cable 20 and are physically linked to the data acquisition/processing, vacuum generating and optional grout pumping subsystems. The sampler module's 2 vacuum tube 17, fiber optic cables 18 & 19 for transmission and receiving, and heater electrical cable 15 are also included in the umbilical cable that is passes through the hollow push rods 1 to the surface.

Figure 2:
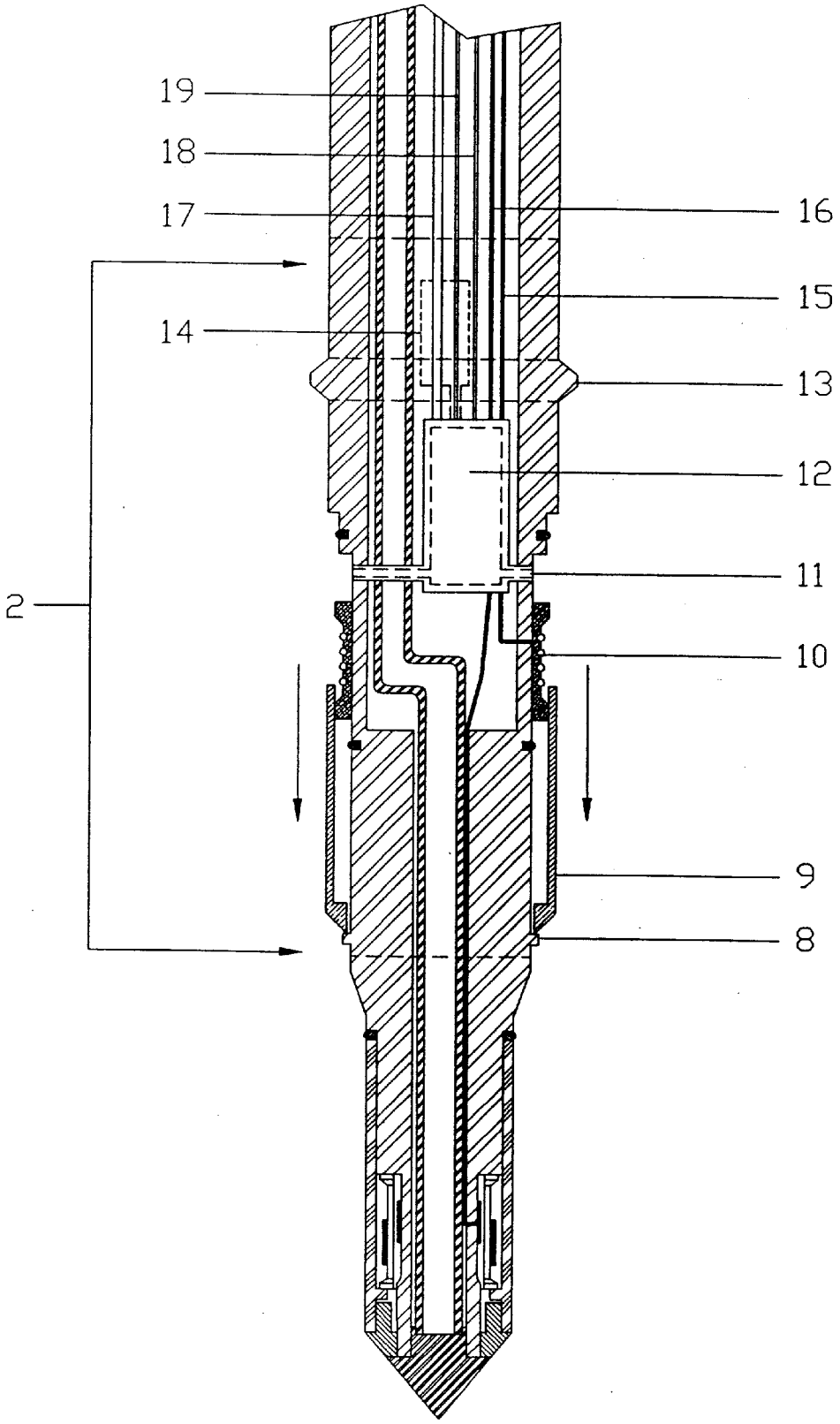
FIG. 2 further shows FIG.1 where the ports are opened during a retraction operation of the penetrometer from the hole where a sliding sleeve uncovers the port(s) allowing the analyte to enter the down hole sample chamber within the sampler module.

FIG. 1 also shows the sampler module 2 with a sliding protective cylindrical sleeve 9 embodiment for covering the sampling port(s) 11 and heater element 10. The port(s) 11 are shown in an open position where the sliding sleeve 9 covers both the port(s) 11 and resistance coil heater 10 during an initial push operation. FIG.2 further shows the sliding sleeve 9 during a retraction mode of the penetrometer. The sleeve slides a regulated distance downward as shown and stops due to stop 8 during retraction due to friction with the surrounding bore hole soil thus exposing sampling port(s) 11 and resistance heater 10. Subsurface data is gathered during this mode of operation. Subsequent downward soil penetration of the penetrometer causes the sleeve 9 to slide back and cover sampling port(s) 11 for protection followed by slight retraction of the the penetrometer again to uncover the port(s) 11 to allow data acquisition. Alternatively, a disposable sliding sleeve 9 can slide free of the penetrometer probe during a retraction operation.

Figure 3:
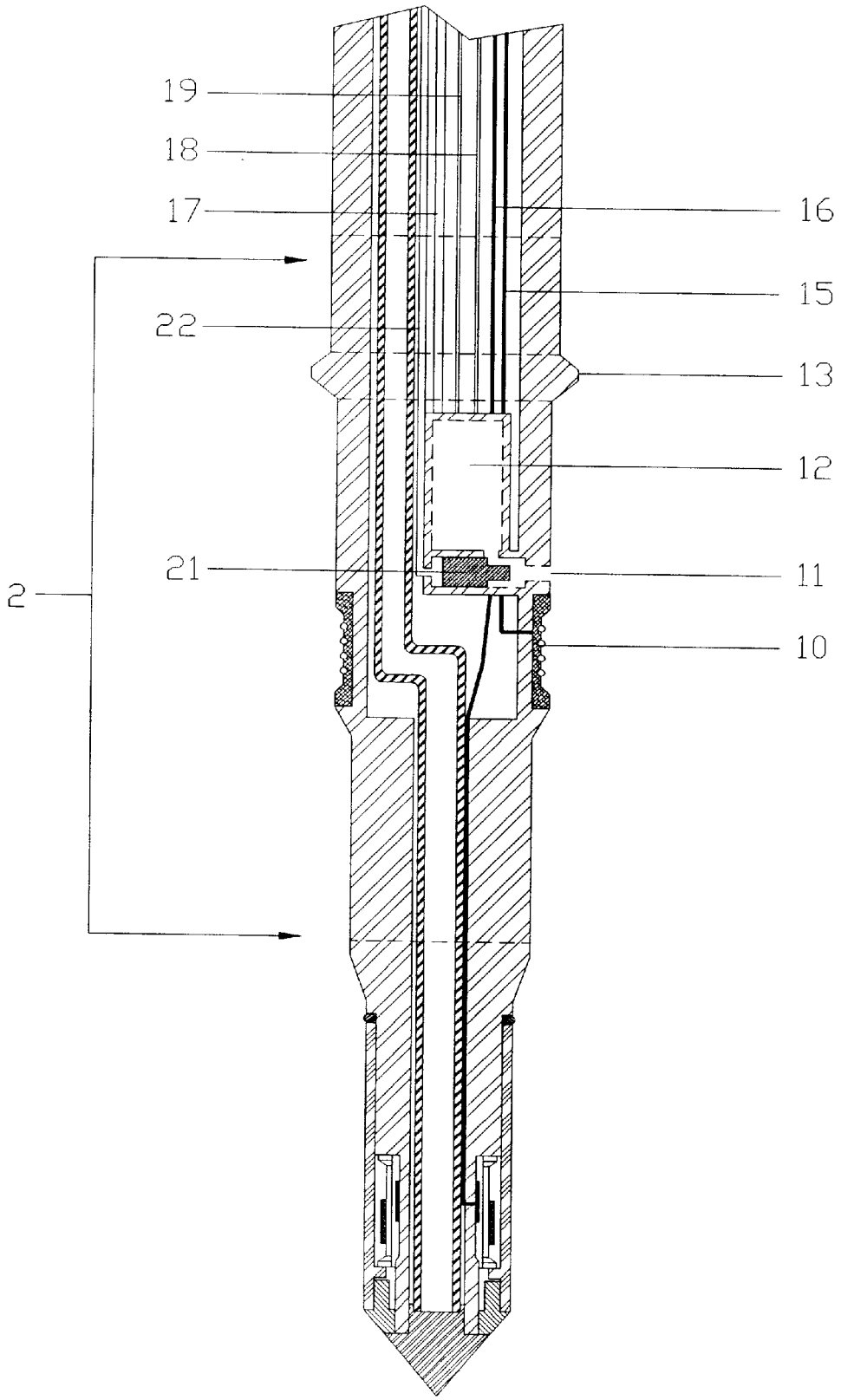
FIG. 3 shows a second embodiment of the aspirating sampler module with sampling port(s) that are opened and closed using a retractable piston.

FIG. 3 shows a retractable piston opening means as a second embodiment of a protective covering feature for opening and closing the sampling port(s) 11. Positive pressure through pneumatic vacuum tube 22 is used to push a piston 21 into the sampling port 11 and thus close the port; negative pressure is used to release the piston 21 and thus open the port. The retractable piston version can be constructed with one or more ports. With the port(s) open to the surrounding soil under examination using a monitored vacuum from a surface vacuum system applied to the sample chamber 12, a specified volume of liquid or gaseous analyte is drawn into the sample chamber 12.

FIG. 1 also shows a surface mounted excitation energy EM excitation source, e.g. a laser or high intensity light, generates EM for transmission via the fiber optic cable 19 to the penetrometer sample chamber 12 for analyte analysis using a fluorescence based technique. Alternatively, the EM excitation source 14 may be Juxtaposed to the sample chamber 12 in lieu of a surface mounted EM excitation source for molecular excitation. In this version, the EM source may be a high energy electrical discharge EM device for producing a plasma state of the analyte for spectral analysis by the spectral analyzer. The fiber optic cable(s) 18 & 19 that link the surface mounted spectral data acquisition/processing equipment pass through the umbilical cable 20 and terminate at the sample chamber's viewing window. The sample chamber 12 aspirates using reverse pressure through the vacuum tube 17 to expel analyte from the sample chamber 12 at various locations as the penetrometer probe goes either down or up a formed bore hole. Once the analyte is expelled, the penetrometer has the capability to be pushed to greater depths for additional sampling. In the sliding sleeve version, the protective sliding sleeve slides into place to protect the sampling port(s) 11 during penetration in the retractable piston version shown in FIG. 3, the piston 21 is moved to the port closed position and penetrometer push is resumed downward.

While this invention has been described in terms of a preferred embodiment, it is understood that it is capable of further modification and adaptation of the invention following in general the principle of the invention and including such departures from the present disclosure as come within the known or customary practice in the art to which the invention pertains and may be applied to the central features set forth, and fall within the scope of the invention and the appended claims.

We claim:

1. An apparatus for in-situ determination of soil contaminants comprising a penetrometer for penetrating subsurface soil media, the penetrometer including multiple hollow push rod segments connected in series to a leading rod segment containing a sampler module having sampling ports and disposed therein an umbilical cable traversing through the hollow rod segments to link the sampler module to surface mounted data acquisition/processing equipment and grout pumping equipment, the umbilical cable made up of electric power leads, a grout transport line, one vacuum tube, electric data transmission lines and optical transmission waveguides for transmitting electromagnetic (EM) radiation through an optical port located within an aspirating downhole sampler module;

the sampler module including i) an external mounted electric resistance heater element surrounding and mounted on a cylindrical ceramic member and connected to the electric power leads whereby soil is heated adjacent to the sampler module; ii) a mechanical member means as a reverse direction sliding sleeve/a retractable piston for protecting the sampler module having at least one sampling port where a sliding sleeve covers and protects the heater element and at least one sampling port during penetration, slides due to friction with adjacent soil to expose the heater element and sampling port(s) during retraction sampling events, and slides to the original covering position during subsequent penetration events, iii) at least one sampling port opening for channeling analyte between an interior sample chamber and surrounding soil bore hole formed by the penetrometer, and iv) the vacuum tube is connected to the sample module to aspirate analyte from the soil into the sample module and to expel by positive air pressure the analyte from the sample module into the surrounding soil;

an EM source means for generating EM radiation that is coupled to the optical transmission means which passes through an optical port in the downhole sample module for irradiating analyte therein whereby the EM radiation induces fluorescence of the analyte; and a spectrum analyzer means for analyzing a corresponding EM spectrum collected at the optical port, the analyzer means is optically coupled to the optical transmission means whereby spectral signature data and location thereof is obtained.

2. The apparatus of claim 1, wherein the penetrometer further including a pointed tip means for facilitating penetration of the penetrometer into the soil, the tip means comprising: i) cone & sleeve strain sensors attached thereto providing stratigraphic data and ii) a detachable tip member with a grout tube disposed through the tip means thereby allowing grout to pass through the detachable tip member during penetrometer retraction from the bore hole initially formed by a penetrometer push operation.

3. The apparatus of claim 1, wherein the mechanical member means for protecting the at least one port and heater element is a sliding protective cylindrical sleeve.

4. The apparatus of claim 3, wherein the sleeve is slidable over the outer surface wall of the penetrometer and the at least one port thereby allowing uncovering of the at least one port.

5. The apparatus of claim 4, wherein the penetrometer further including an outer raised member that stops the sleeve from sliding free of the penetrometer wall during a retraction operation of the penetrometer.

6. The apparatus of claim 4, wherein the sleeve is a disposable sliding sleeve that slides free of the outer penetrometer wall during a retraction operation of the penetrometer.

7. The apparatus of claim 1, wherein the mechanical member means for protecting the at least one port is a piston member for opening and closing the at least one port, whereby positive pressure via the at least one vacuum tube is used to push the piston into the at least one port for closing and negative pressure is used to release the piston member for opening the at least one port wherein the soil analyte under examination is aspirated and monitored at the sample chamber.

8. The apparatus of claim 1 furthering comprising a driving means for driving and controlling the penetrometer into the soil, the driving means also controls sampling rates of the penetrometer for effective data acquisition and a data storage and visual display means of the data produced by the spectrum analyzer means.

9. The apparatus of claim 1, wherein the EM excitation source is located at a ground surface location.

10. The apparatus of claim 1, wherein the EM excitation source is disposed in the sampler module.

11. The apparatus of claim 10, wherein the EM excitation source is a high energy electrical discharge device whereby the analyte is excited to a plasma state for spectral analysis.

* * * * *